United States Patent [19]

Diez

[11] Patent Number: 4,588,099

[45] Date of Patent: May 13, 1986

[54] FILM SEAL FOR CONTAINER

[75] Inventor: Donald E. Diez, Birchwood Village, Minn.

[73] Assignee: Minnesota Mining and Manufacturing Company, St. Paul, Minn.

[21] Appl. No.: 727,149

[22] Filed: Apr. 25, 1985

[51] Int. Cl.[4] ..... B65D 53/04
[52] U.S. Cl. ..... 215/232
[58] Field of Search ..... 215/232; 220/359

[56] References Cited

U.S. PATENT DOCUMENTS

| | | | |
|---|---|---|---|
| 3,632,004 | 1/1972 | Grimes | 215/232 |
| 3,767,076 | 10/1973 | Kennedy | 215/232 |
| 4,171,084 | 10/1979 | Smith | 220/359 X |
| 4,209,126 | 6/1980 | Elias | 215/232 X |

*Primary Examiner*—Donald F. Norton
*Attorney, Agent, or Firm*—Donald M. Sell; James A. Smith; David L. Weinstein

[57] ABSTRACT

Tamper-resistant innerseals that bond firmly to the lips of lidded or capped plastic containers. The innerseals incorporate a metallic foil having a biaxially oriented polymeric film applied to one surface thereof.

18 Claims, 3 Drawing Figures

FILM SEAL FOR CONTAINER

TECHNICAL FIELD

This invention relates to a polymeric film which can be utilized as a seal for the opening of a container, such as a bottle, which utilizes a conventional screw cap or snap cap closure. More specifically, the polymeric film can be utilized in conjunction with other components to provide a seal over the container opening by means of induction heating.

BACKGROUND ART

Containers for the dispensing of consumer products such as medicines, foods, etc. which utilize screw top and snap cap closures, are typically sealed to prevent tampering with the goods therein prior to ultimate purchase by the consumer. Over the past few years, and especially in the United States, such tampering with goods has occurred, resulting in injury, often severe, and in some cases, even death. Accordingly, it has become apparent that more effective systems for the sealing of such containers are necessary.

One system which has met with significant commercial success bears the trademark "Safe-Gard". This system provides a hermetic seal that is suitable for use with ingestible commodities. The seal is particularly effective for products which should preferably be kept free from contamination, oxidation, and/or moisture.

The seal employed in the "Safe-Gard" system typically comprises in order from top to bottom: a pulp board backing, a wax coating, aluminum foil, and a heat sealable polymeric film coating. These materials are typically supplied in strip form as a laminated structure, and applied to a filled container in conventional fashion during the filling process. After being capped, the filled container is passed through an electromagnetic field generated by induction heating equipment, which heats the outer edge of the aluminum foil, thereby bringing about the melting of the heat sealable polymeric film coating. After the container is removed from the induction field, the heat sealable coating will cool and the foil will be hermetically sealed to the lip of the container. During the induction heating step, the wax coating between the foil and pulpboard backing also melts, destroying the bond therebetween. While the wax remains in a molten state for a short period of time, it is wicked up or absorbed by the pulpboard backing such that the wax bond is permanently weakened. Upon removal of the cap from the container, the pulp backing remains with the cap's inner surface, which contacts and seals the lip of the container after the foil liner has been removed by the consumer.

In certain embodiments of the "Safe-Gard" system, the heat sealable polymeric film coating becomes very tough upon cooling, so tough that some consumers, particularly the elderly or arthritis sufferers, find it difficult to rupture the innerseal in order to obtain access to the contents of the container. Furthermore, it has been found that some commercially available heat sealable polymeric film coatings or adhesives are ineffective for use with various container materials in the induction innerseal system. For example, while an adhesive may be highly effective for polyethylene containers, it may be relatively ineffective with other conventional plastic containers, such as polystyrene or polypropylene.

It has now been discovered that the polymeric films of this invention, when utilized in a heat-activated or induction-activated innerseal system, will provide a strong, heat-sealed bonds on containers, made of popular plastic materials such as polystyrene, polyethylene, polypropylene.

SUMMARY OF THE INVENTION

In one aspect, this invention involves polymeric films suitable for use in conjunction with other elements to provide an innerseal over the open mouth of containers. The polymeric film is formed of a biaxially oriented polymeric material that can be bonded to the lip which forms the mouth of the container by means of heat sealing. The polymeric film should be biaxially oriented in order that the resulting seal be structurally stable yet readily rupturable by such people as the elderly or arthritis sufferers.

The advantage of the innerseal of this invention is that it is not peelable by the fingers, yet it is readily rupturable by light finger pressure. Thus, tampering will be readily indicated, but physically impaired people will have ready access to the contents of the container.

In another aspect of this invention, biaxially oriented polymeric film can be bonded to the lip of a container to provide an outer seal. In the case of an outer seal, additional elements, e.g. backing, wax, foil, need not be utilized.

BRIEF DESCRIPTION OF THE DRAWINGS

Understanding of the invention will be enhanced by referring to the accompanying drawing, in which like numbers refer to like parts in the several views and in which.

DETAILED DESCRIPTION

Figure 1:
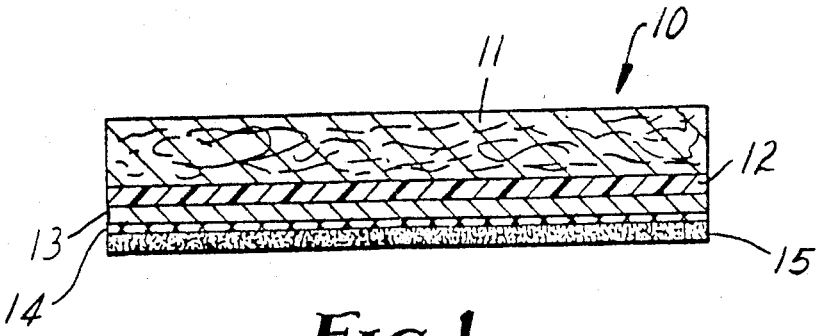
FIG. 1 is a greatly enlarged cross section of the inner seal made in accordance with the invention.

The basic elements of an innerseal system 10 for containers based on induction heating comprise a pulpboard backing 11, a layer 12 of wax coated thereover, a metallic foil 13, preferably aluminum, applied over the wax, an adhesive layer 14 applied over foil layer 13, and a biaxially oriented polymeric film 15 bonded by adhesive layer 14 to foil layer 13. The pulpboard backing 11, wax layer 12, metallic foil 13, an adhesive layer 14, and polymeric film 15 are all coextensive. In addition, there may be other layers of materials, such as polyethylene terephthalate, polyvinylidene chloride, ethylene/vinyl acetate, and the like, interposed between the polymeric film and the metallic foil to heighten particular characteristics, such as, for example a vapor barrier. Also, there may be a film, e.g., paper, interposed between the polymeric film and the metallic foil to provide for increased adhesion, to increase the ability to detect tampering, to increase web rigidity for ease of handling during coating operations, or for other purposes.

In some instances, a pulpboard material may already be included within the container cap to conform to irregularities in the container opening. In this instance, the wax layer and the pulpboard backing may be unnecessary. Furthermore, if resealability is unnecessary, as for example with a snap cap closure, these elements again may be omitted. However, the rigidity of the web is preferably maintained sufficiently high for disc punching, web handling, and related manufacturing operations.

The basic construction of a web for induction sealing of containers typically comprises as a first element a paper pulpboard backing 11 which need not be greater than about 1500 micrometers thick, and is preferably between about 125 and about 1000 micrometers thick. An example thereof is 875 micrometer white lined pulpboard.

The second element, applied over the pulpboard backing 11, is a wax layer 12, typically less than about 100 micrometers thick, and preferably about 25 micrometers thick. An example of a commerically available wax suitable for the wax layer 12 is $B^2$-175 microcrystalline wax, commercially available from Bareco.

The third element is a metallic foil 13, preferably aluminum. The foil 13 need not be greater than about 75 micrometers thick, and preferably is from about 5 to about 37.5 micrometers thick. An example thereof is 1145-0 aluminum foil commercially available from Alcoa.

The fourth element is an adhesive layer 14. The adhesive is preferably a commercially available polylurethane adhesive, e.g. "Adcote" 503 available from Morton. The adhesive is preferably applied at a coating weight of about 3 lb./3000 sq. ft.

The fifth element is, of course, the biaxially oriented polymeric film 15 which need not be greater than 100 micrometers thick, and is preferably from about 25 to about 75 micrometers thick. Methods for orienting polymeric film are well known in the art and are described, for example, in *The Science and Technology of Polymer Films*, Vol. I, edited by Orville J. Sweeting, Interscience Publishers (New York: 1968).

The biaxially oriented polymeric film is preferably formed of the same material as the lip which forms the mouth of the container. For example, if the lip of the container is formed of polystyrene, the biaxially oriented polymeric film 14 is preferably biaxially oriented crystalline polystyrene or a copolymer containing a majority, i.e. greater than 50%, of styrene units. However, the chief requirement of the biaxially oriented polymeric material of the film is that it be heat sealable to the lip which forms the mouth of the container. It is also highly desirable that the film be impervious to liquids.

The material forming the polymeric film and the material forming the lip of the container are preferably compatible. As used herein, "compatible" means capable of being welded into a homogeneous joint upon being subjected to a temperature, at atmospheric pressure, sufficiently high to effect melting of the film material and container lip material. Although the film material and lip material are not required to be totally compatible, compatibility should be sufficient to form a seal that cannot be removed by manual peeling. Generally, both the polymeric film material and the polymeric lip material should have heat sealability characteristics that are substantially similar, i.e. the sealing temperatures, pressures, and dwell times at which seals can be formed should be substantially similar.

Preferred materials for the biaxially oriented films are the conventional heaat sealable materials, e.g. polystyrene, polyolefins, such as polyethylene and polypropylene. The vinyls, saran, acetate, and polyesters are less preferred for this invention, but are still suitable, particularly when the induction heating device can localize heating so as to minimize shrinkage of the oriented film. Preferred materials for container lips are styrene homopolymers and copolymers when the biaxially oriented films are made from styrene homopolymers and copolymers, polyethylene when the biaxially oriented films are made from polyethylene, and polypropylene when the biaxially oriented films are made from polypropylene. Representative examples of styrene copolymers include styrene/-methylstyrene, styrene/acrylonitrile, and styrene/methyl methacrylate copolymers.

It has been discovered that by using biaxially oriented polymeric film, a tamper-indicating bond can be formed on the lip of the container, i.e. the film essentially is welded onto the lip of the container so that it cannot be removed by peeling. Yet, the film can be readily ruptured by means of light pressure, such as by a finger. If the film were not biaxially oriented, the innerseal would be tough and would not be readily rupturable by light pressure.

As discussed earlier, other layers of materials can be added to enhance desired properties, and if reclosability of the container is not necessary, the pulpboard backing 11 and wax layer 12 are not required.

To prepare a web 10 for innerseal applications, a metallic foil 13, or paper-backed metallic foil 13, is obtained directly from vendors. If desired, a film, e.g. polyester, can be conveniently applied to foil 13 via conventional technques, e.g., gravure roll coating. Polyester is resistant to high temperatures and provides an excellent vapor barrier, two characteristics frequently requested by packagers. The biaxially oriented polymeric film 15 of the invention can then be laminated onto one major surface of metallic foil 13 (or onto the paper or film coating thereon, if present) by means of adhesive 14. The remaining major surface of metallic foil 13 can then be roll-coated with microcrystalline wax and cooled. The wax-coated surface can then be placed in contact with the surface of a pulpboard sheet and passed through squeeze rolls at elevated temperature, thereby laminating foil 13 to pulpboard backing 11 while leaving polymeric film 15 exposed. The resulting inner seal construction can then be slit to suitable widths, from which circular discs, corresponding to the inner diameter of screw-on or snap-top lids, can be die cut.

As is well known in the innerseal art, the combination of the various sheets and foils in the foregoing embodiment represents only one specific construction. To illustrate, the foil may be prelaminated to a sheet of paper, the pulpboard may be prelaminated to a polyester film, etc.

In an alternative construction, pulpboard backing 11 can be replaced with a backing made from paper, chipboard, polymeric foam, or the like, and microcrystalline wax layer 12 can be replaced by a layer of an adhesive, e.g., pressure-sensitive adhesive. This adhesive exhibits sufficient adhesive strength to permanently bond backing 11 to foil 13.

Figure 2:
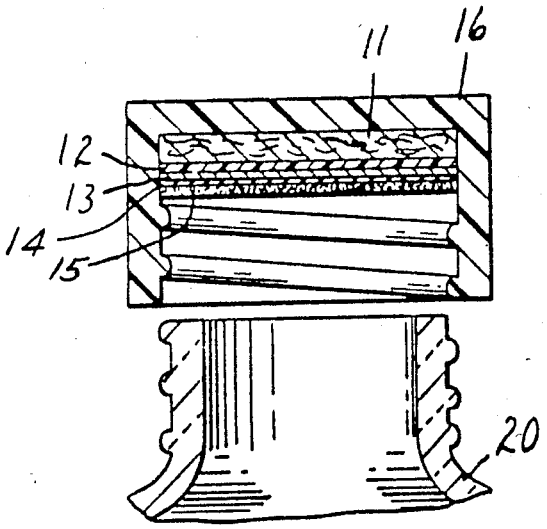
FIG. 2 is a cross sectional view of a screw-on cap having a circle of the product of FIG. 1 bonded to the lower surface of the cap, which is positioned above a container (only the upper portion of which is shown) prior to installing the cap on the mouth of the container.
Figure 3:
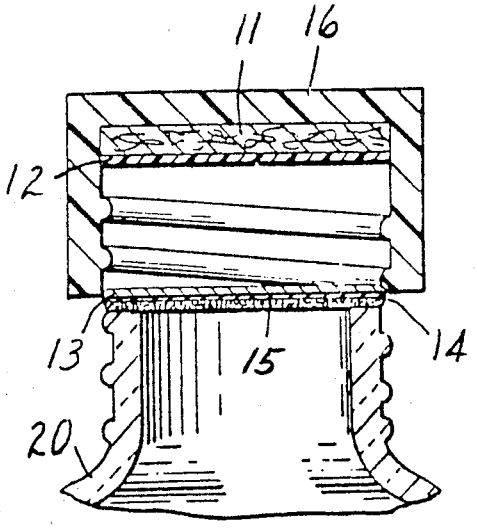
FIG. 3 is similar to FIG. 2 but shows the result of heat sealing the mouth of the container and subsequently removing the cap.

FIG. 2 shows composite innerseal 10 mounted inside screw-on top 16. After container 20 has been filled cap 16 is screwed into the mouth of container 20, after which the capped container is passed through a radio frequency field, the resulting eddy currents inductively heating metal foil 13 and simultaneously melting wax layer 12 and polymeric film 15. As wax 12 melts, it is absorbed by pulpboard backing 11, greatly weakening the bond between backing 11 and metal foil 13. As the capped container cools to room temperature, polymeric film 15 bonds firmly to the lip of container 20. When cap 16 is subsequently unscrewed from container 20, pulpboard backing 11 twists free from foil 13, which remains firmly bonded to the lip of container 20 by means of heat-sealed polymeric film 15, thereby providing a tight seal which prevents leakage.

The polymeric film 15 of this invention provides a strong permanent bond to the container lip. The thus-formed innerseal is not peelable, the advantage of that being that tampering with the innerseal is readily detectable. Yet, after the cap has been twisted off or snapped off, the biaxially oriented polymeric film can be ruptured by light pressure, e.g. as with a finger, so that the consumer can readily have access to the contents of the container.

For certain containers where reclosability is not required, the backing and the wax need not be used. In situations where induction heating is not used, e.g., where heating is conducted by means of a heated platen, the foil and the adhesive for bonding the biaxially oriented polymeric film to the foil are also unnecessary.

The invention will now be more fully described by the following non-limiting examples.

EXAMPLE 1

Biaxially oriented crystalline polystyrene film having a thickness of 50 micrometers ("Trycite", commercially available from Dow Chemical Company) was adhered with polyurethane adhesive ("Adcote" 503, commercially available from Morton) to one face of 25-micrometer aluminum foil.

As is conventional, the other face of the aluminum foil was then roll coated with molten (95° C.) microcrystalline wax and cooled, leaving a coating weight of about 7.5 mg/in$^2$. The wax-coated surface was then placed in contact with the surface of a pulpboard sheet and passed through squeeze rolls at a temperature of 55° C., thereby laminating the aluminum foil to the pulpboard while leaving the polystyrene film exposed. The resultant inner seal construction was then slit to suitable widths, from which circular discs, corresponding to the inner diameter of screw-on lids, were die-cut. A suitable adhesive was then employed, in conventional manner, to bond the pulpboard face of one of these discs to the inner surface of the screw-on cap for a polystyrene jar.

The lid was screwed onto a polystyrene jar using appropriate torque; for example, with a polystyrene jar have a 38-mm inside diameter. The jar was then passed through a radio frequency field adjacent the lid for about 0.5–1.0 second, which was sufficient to bond the polystyrene film to the lip, simultaneously melting the microcrystalline wax, which diffused into the pulpboard and weakened the bond between the foil and pulpboard. The sealed jar was then cooled to room temperature. The seal could not be peeled from the lip of the jar by the fingers. The seal was ruptured by light finger pressure.

EXAMPLE 2

Example 1 was repeated, with the only exceptions being that the biaxially oriented polymeric film was polypropylene and the jar was made of polypropylene. The seal could not be pulled from the lip of the jar by the fingers, but it was ruptured by light finger pressure.

EXAMPLE 3

Example 1 was repeated, with the only exception being that the biaxially oriented film was formed of a styrene copolymer ("Trycite", commercially available from Dow Chemical Company). The seal could not be pulled from the lip of the jar by the fingers, but it was ruptured by light pressure.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An article suitable for preparing a container innerseal comprising a pulpboard backing, a layer of wax coated over said backing, metallic foil overlying said wax layer, and a biaxially oriented polymeric film adhered to said metallic foil by means of an adhesive layer.

2. The article of claim 1 wherein the metallic foil comprises aluminum.

3. The article of claim 1 wherein the layer of wax coated over said backing comprises microcrystalline wax.

4. The article of claim 1 wherein the polymeric film is selected from the group consisting of styrene homopolymers, styrene copolymers, polyethylene, and polypropylene.

5. A container innerseal comprising a pulpboard backing, a layer of wax coated over said backing, metallic foil overlying said wax layer, and a biaxially oriented polymeric film adhered to said metallic foil by means of an adhesive layer.

6. The article of claim 5 wherein the metallic foil comprises aluminum.

7. The article of claim 5 wherein the layer of wax coated over said backing comprises microcrystalline wax.

8. The article of claim 5 wherein the polymeric film is selected from the group consisting of styrene homopolymers, styrene copolymers, polyethylene, and polypropylene.

9. An article suitable for preparing a container innerseal comprising a backing, a layer of adhesive coated over said backing, metallic foil overlying said adhesive layer, and a biaxially oriented polymeric film adhered to said metallic foil by means of an adhesive layer.

10. The article of claim 9 wherein the metallic foil comprises aluminum.

11. The article of claim 9 wherein the polymeric film is selected from the group consisting of styrene homopolymers, styrene copolymers, polyethylene, and polypropylene.

12. A container innerseal comprising a backing, a layer of adhesive coated over said backing, metallic foil overlying said adhesive layer, and a biaxially oriented polymeric film adhered to said metallic foil by means of an adhesive layer.

13. The article of claim 12 wherein the metallic foil comprises aluminum.

14. The article of claim 12 wherein the polymeric film is selected from the group consisting of styrene homopolymers, styrene copolymers, polyethylene, and polypropylene.

15. A container having a lip formed of a polymeric material, said lip having a biaxially oriented polymeric film heat-sealed thereto.

16. The container of claim 15 wherein said lip is formed from a heat-sealable polymeric material.

17. The container of claim 15 wherein said biaxially oriented film is selected from the group consisting of styrene homopolymers, styrene copolymers, polyethylene, and polypropylene.

18. The container of claim 12 wherein said lip is formed from a polymer selected from the group consisting of from styrene homopolymers, styrene copolymers, polyethylene, and polypropylene.

* * * * *